US005577713A

United States Patent [19]

Navarez

[11] Patent Number: 5,577,713

[45] Date of Patent: Nov. 26, 1996

[54] POST SUPPORT WITH OFFSET SLANTED STAKE AND METHOD FOR USING SAME

[75] Inventor: Jack Navarez, 210 Kipling Ave., Ben Lomond, Calif. 95005

[73] Assignee: Jack Navarez, Ben Lomond, Calif.

[21] Appl. No.: 304,702

[22] Filed: Sep. 12, 1994

[51] Int. Cl.[6] ..... E04H 17/22

[52] U.S. Cl. ..... 256/64; 256/35; 52/146

[58] Field of Search ..... 256/65, 64, 63, 256/31, 35, 59, DIG. 2; 52/514, 146

[56] References Cited

U.S. PATENT DOCUMENTS

| | | | |
|---|---|---|---|
| 437,155 | 9/1890 | Helfenberger | 256/DIG. 2 |
| 509,102 | 11/1893 | Rodgers | 52/146 X |
| 621,000 | 3/1899 | Warner | 52/146 X |
| 772,795 | 10/1904 | Field | 52/146 X |
| 779,057 | 1/1905 | Turner | 256/65 X |
| 789,242 | 5/1905 | Stewart | 256/DIG. 2 |
| 814,403 | 3/1906 | Smith | 256/35 |
| 889,647 | 6/1908 | Ward | 256/35 X |
| 1,178,641 | 4/1916 | Henkel | 52/146 X |
| 3,785,107 | 1/1974 | Garretson | 256/59 X |
| 4,296,584 | 10/1981 | Lempa . | |
| 4,516,365 | 5/1985 | Chapman . | |
| 5,143,472 | 9/1992 | Reed et al. | 256/59 X |

*Primary Examiner*—Anthony Knight

[57] ABSTRACT

An anchoring device for retrofitting a possibly rot weakened wood post consisting of a slanted metal stake welded to a vertical attachment plate; where the device is bolted via the plate to the base area of the post above the ground; while the method includes digging an offset footing hole, then setting the bottom half of the stake in the footing hole with poured concrete after plumbing the post, temporarily bracing it, and mounting the device on it.

20 Claims, 6 Drawing Sheets

POST SUPPORT WITH OFFSET SLANTED STAKE AND METHOD FOR USING SAME

BACKGROUND—FIELD OF INVENTION

This invention relates to wood fencing, specifically to an improved method of retrofitting or even replacing a post having a rotting base.

BACKGROUND—DESCRIPTION OF PRIOR ART

Heretofore, fencepost repair included the following methods both patented and nonpatented:

Fences are completely rebuilt. New posts are installed offset existing posts along the fenceline. The existing cutoff posts with concrete foundations are left in place. This is labor intensive and expensive considering global wood shortages. The new posts will rot again.

Fencepost is "sistered" with a new wooden "stub." This is a short post positioned adjacent to and bolted to the existing post. The stub orientation is offset either on or off the fenceline. The stub is set at typically full post depth (2 to 3 feet) in new concrete. This requires labor-intensive removal of existing concrete on one side of the existing post. The new wood—even treated wood—is still prone to future rot.

U.S. Pat. No. 4,516,365 (Chapman, May 14, 1985) allows splinting the existing fencepost using a two-piece sandwich splint. Chapman's post attachment above the rotted area is strong. He uses channel-shaped splints attached to the post with multiple nails or screws. Below-ground attachment, however, relies on wedging the product between the post remains and the existing concrete fill. The strength attained can vary depending upon three factors. These are existing soil condition, the extent of wood rot, and the amount and condition of the old existing fill. Attaining vertical post orientation after installation is a gamble due again to the above three factors.

This is a quick and easy "mend" of rotten fence posts. However the currently marketed product appears to lack longevity. This statement is supported by the patent's installation method. That is of driving the metal splints down into a known moisture source. The sheet metal may have its rust resistant layer scratched and damaged. The product is now subject to the same corrosive condition the result of which this invention is meant to correct.

U.S. Pat. No. 4,296,584 (Lempa, Oct. 27, 1981) uses a method of anchoring in new concrete a metal brace. Lempa's device has a good looking flush installed profile. However, the multiple bends in its brace design appear to sacrifice end-to-end stiffness especially at the ground level point.

OBJECTS AND ADVANTAGES

It is an object of this invention to produce strong retrofitted fence posts.

It is an object of this invention to provide longevity when properly installed.

It is an object of this invention to minimize manufacturing costs in making this product.

It is an object of this invention to minimize installation costs associated with this product.

It is an object of this invention to create an asthetic addition to the property's landscape when using this product.

LIST OF REFERENCE NUMERALS

Figure 2:
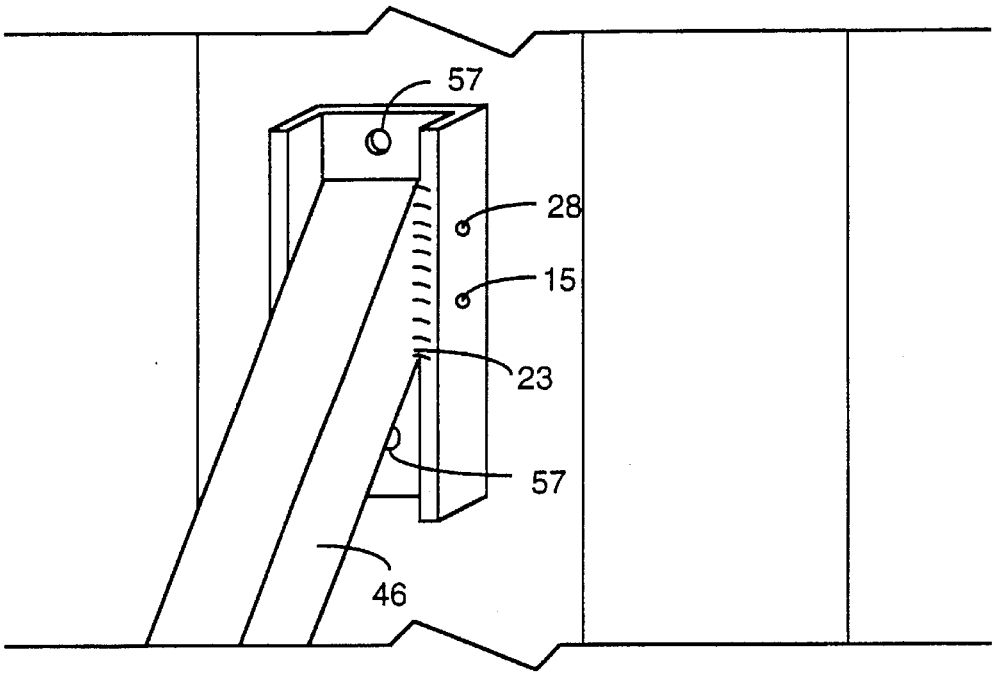
FIG. 2 is perspective view of an embodiment using a channel instead of a plate for stake adaptation and attachment to the post.
Figure 3:
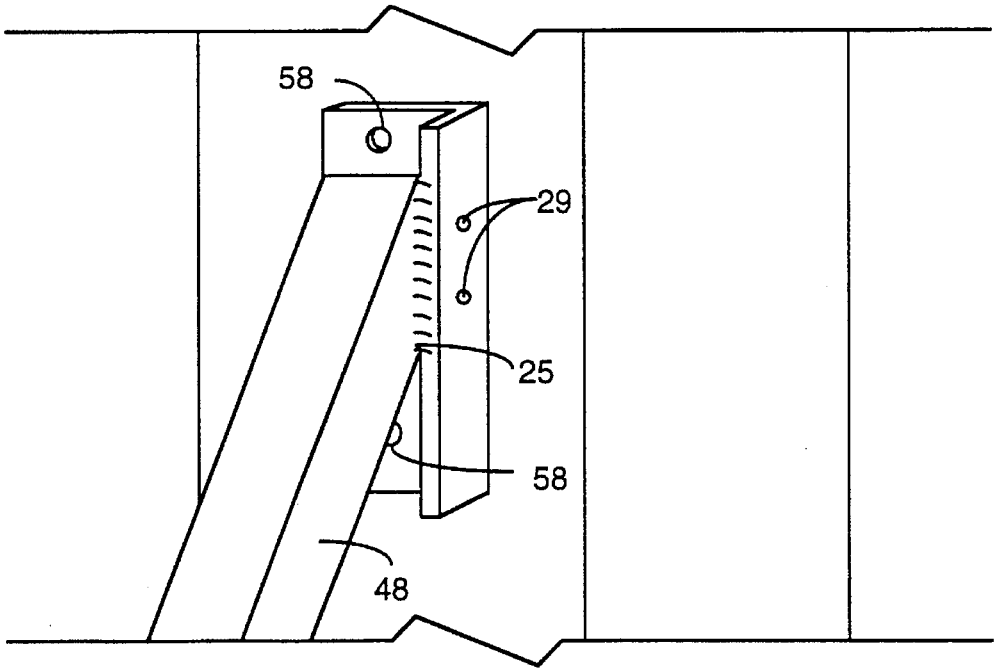
FIG. 3 is a perspective view of an embodiment using a right angle bracket instead of a plate for adaptation and attachment.
Figure 4:
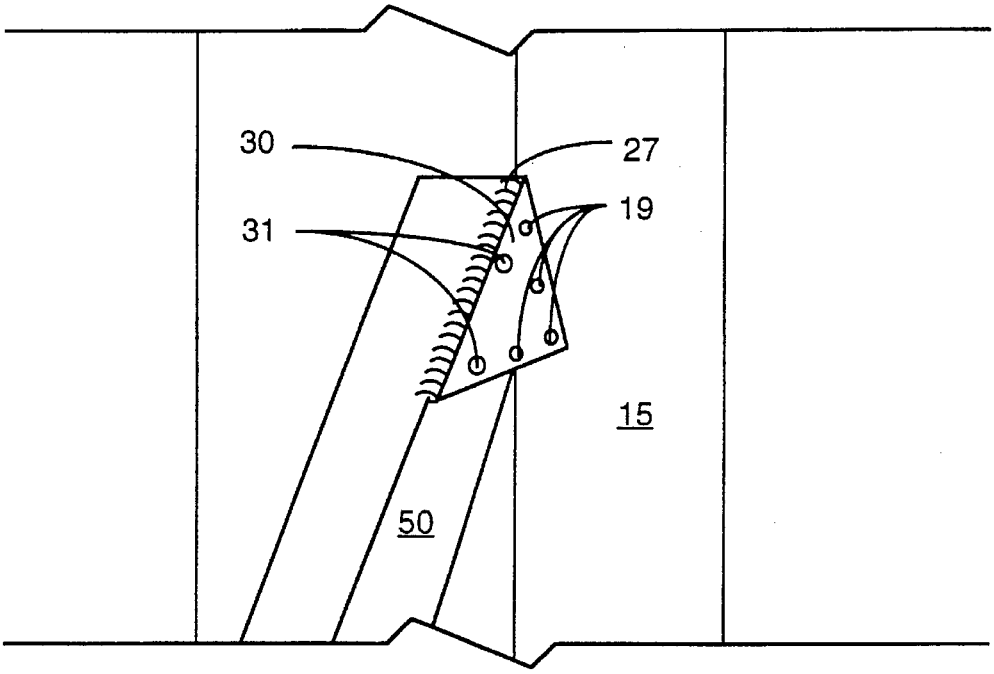
FIG. 4 is a perspective view of an embodiment using a gusset instead of a plate for adaptation and attachment.
Figure 5:
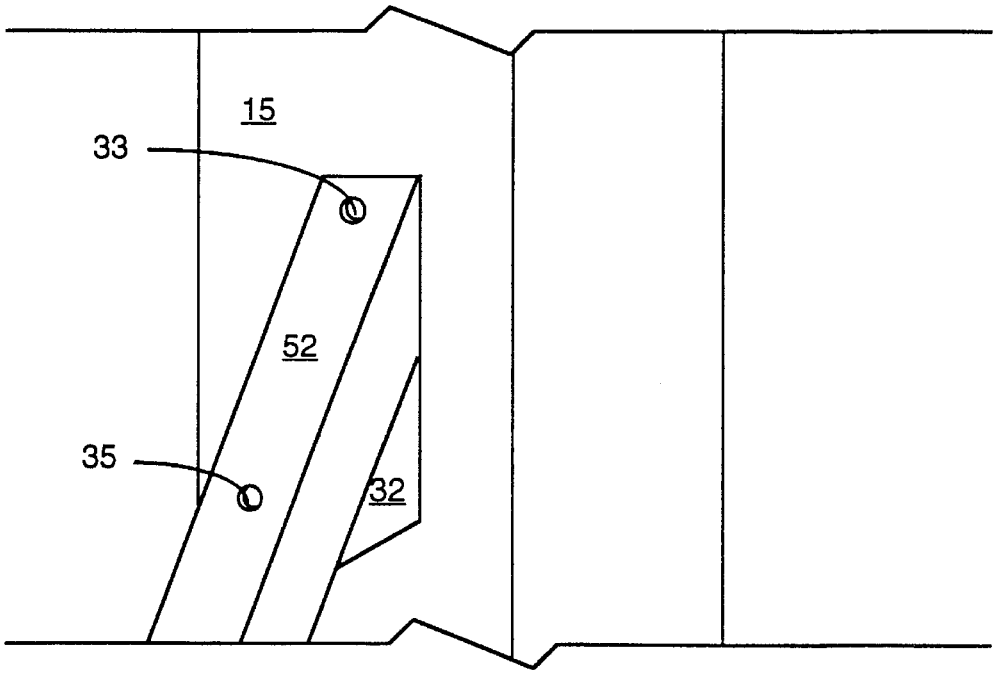
FIG. 5 is a perspective view of an embodiment using a wedge instead of a plate for adaptation and attachment.
Figure 6:
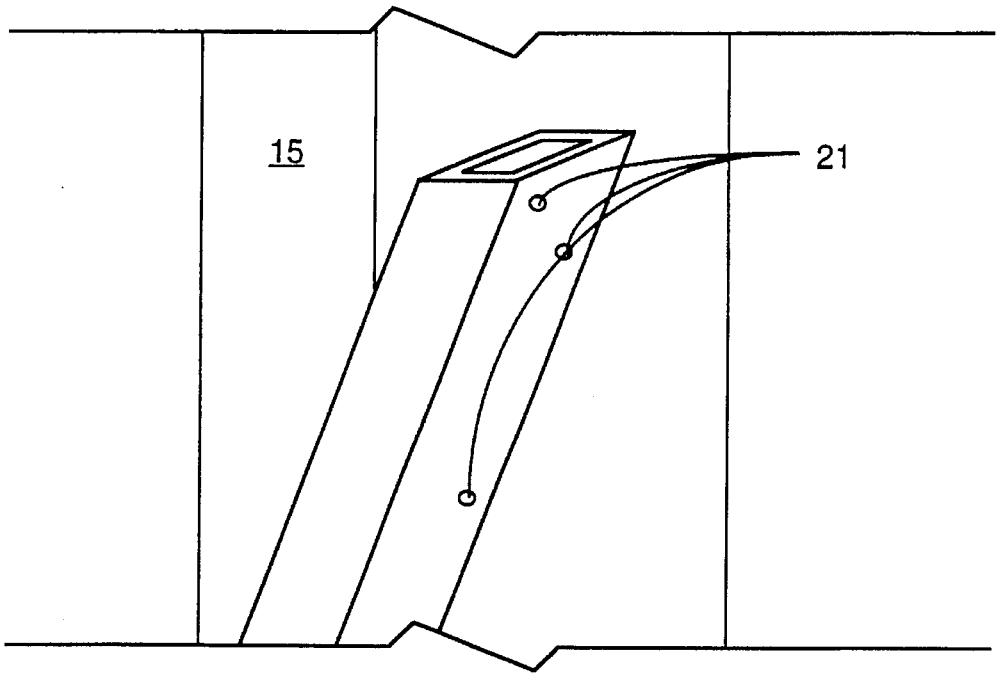
FIG. 6 is a perspective view of another embodiment of a stake according to the present invention.
Figure 7:
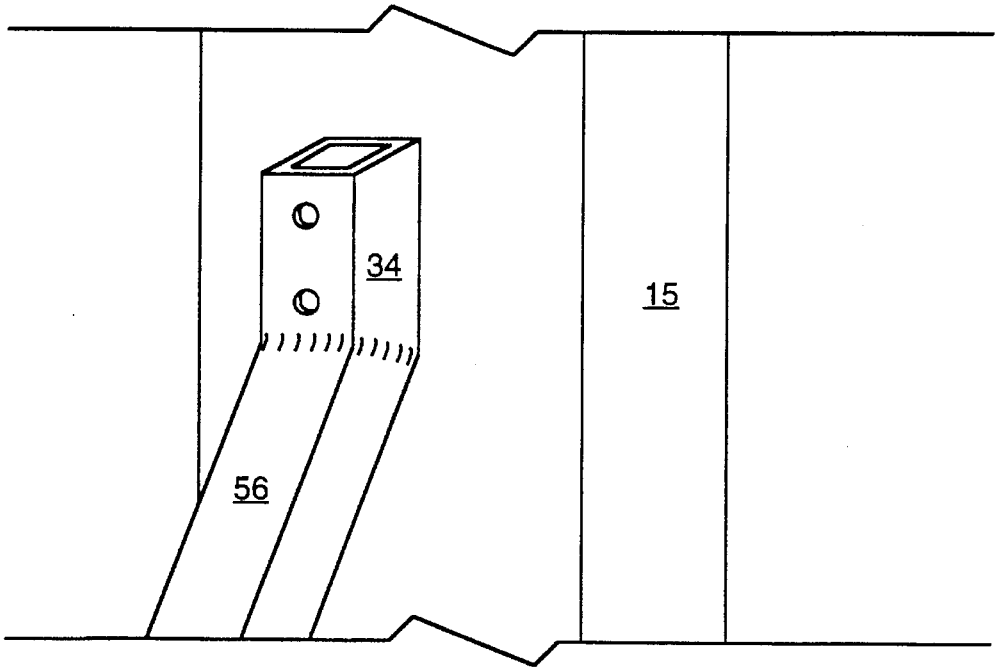
FIG. 7 is a perspective view of an anchoring device with an embodiment using a modified stake end. Here, the stake itself attaches directly to the front of the post.

12 Stake
13 Ground
14 Attachment plate
15 Post
16 Mounting hole
17 Bottom mounting hole
18 Stake side
19 Gusset mounting holes
20 Stake front
21 Direct Stake Mounting holes (distal end)
22 Weld
23 Channel weld
24 Plate edge
25 Right-angle bracket weld
26 Lower plate/stake gap
27 Gusset weld
28 Connection holes
29 Cutoff stake proximal end
30 Gusset
31 Gusset connection holes
32 Wedge spacer
33 Top wedge mounting hole
34 Vertical stake head
35 Bottom wedge mounting hole
36 Dug hole
38 Existing foundation
40 Existing foundation lip
42 New concrete
44 Ground level
46 FIG. 2 stake
48 FIG. 3 stake
50 FIG. 4 stake
52 FIG. 5 stake
54 FIG. 6 stake
56 FIG. 7 stake
57 Channel mounting holes
58 Right-angle bracket mounting holes
60 Optional Decorative Cover

DESCRIPTION—FIGS. 1 TO 7

Figure 1:
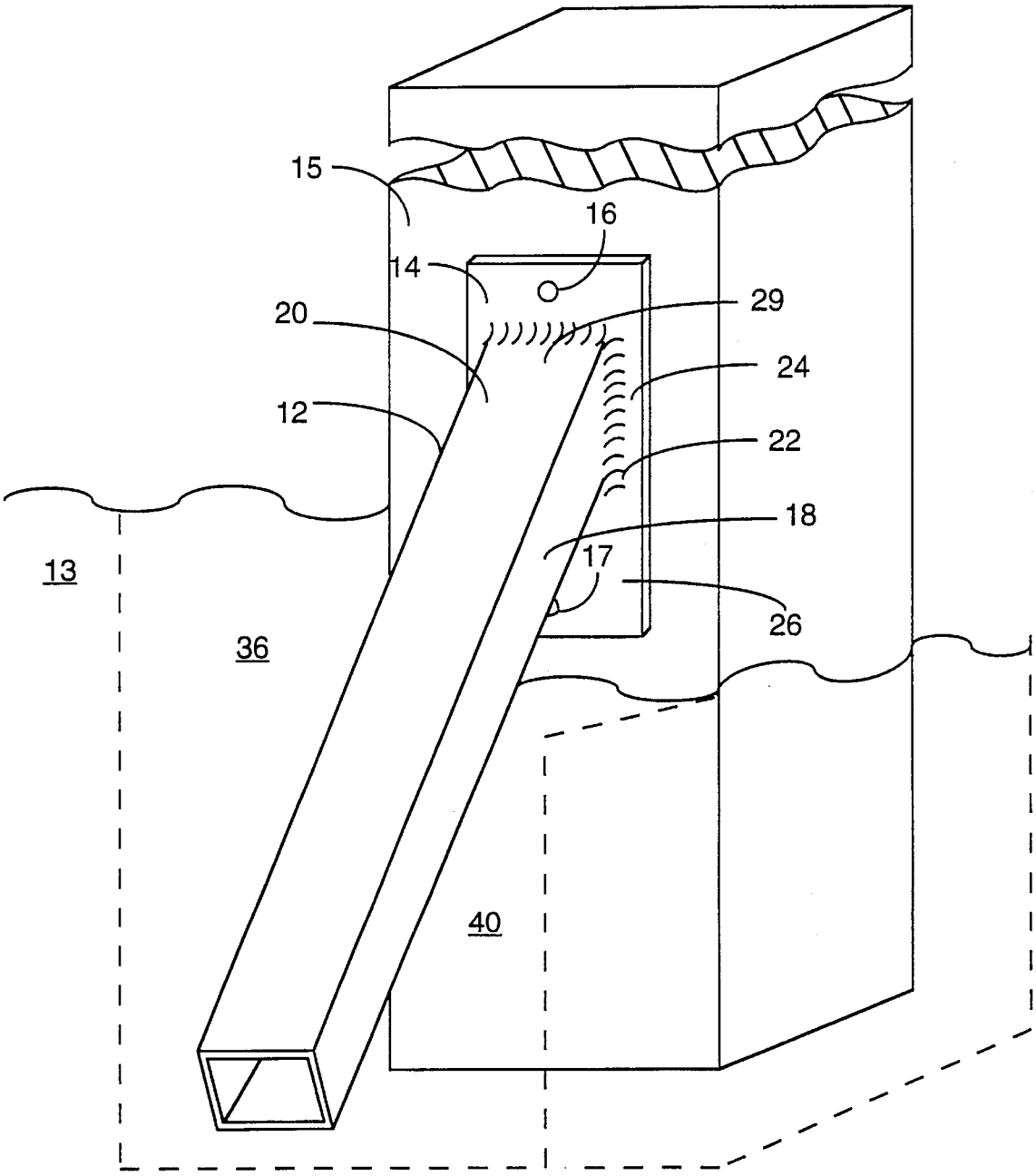
FIG. 1 is a perspective view of the anchoring device represented by this invention.

FIG. 1 describes the preferred embodiment of the invention. It consists of two major parts-the stake 12 for rigidity in the ground 13, and the adaptive device being an attachment plate 14 to transfer this rigidity to the post 15.

The approximately 3' long stake 12 is generally 1½" square metal tubing typically of steel. This choice of material maximizes strength in relation to cost. But other corrosion-resistant materials such as brass, aluminum or plastic can form alternate embodiments. Further embodiments of the stake 12 are solid round metal rod and round metal tubing.

The approximately 2"×12" attachment plate 14 is made of generally ⅛" steel of width at least ½" wider than the width of the stake 12. Again, alternative stake material embodiments previously mentioned can be applied to the flat attachment plate 14. Mounting holes 16 & 17 are located at the plate ends.

Thus, using only two parts of standard materials and sizes minimizes manufacturing costs.

The connection between the stake 12 and the attachment plate 14 is prepared with a cut off stake end 29 at a very acute angle (near 10 degrees to the plane of the stake front 20). This flat cut is positioned centered on the attachment plate 14 between the plate's longitudinal edges 24. The tip of the flat cut is positioned adjacent to the top mounting hole 16. Welds 22 are placed along the edges of the flat cut. These bond the cutoff stake end 29 to the overlapping plate edges 24. The bottom mounting hole 17 is now covered by the angled stake 12. But the remaining gap 26 between the lower plate area and stake 12 still allows sufficient clearance for hand access to the mounting hole 17.

Corrosion resistance is established by preparation and painting with high-quality paint.

Metal channel stock (FIG. 2) and metal right-angle stock (FIG. 3) embody substitutes for the plate style attachment device. These connect via welds 23 & 25 to the stake 46 & 48. Alternatively, through bolts can be placed in side connecting holes 28 & 29 for stake connection. Post attachment for these two embodiments is accomplished with through bolts in mounting holes 57 & 58.

FIG. 4 describes another embodiment of an attachment device. This consists of a triangular or rectangular gusset 30. It connects to the side of the stake 50 via weld 27 or bolts using connection holes 31. The gusset mounts to the side of the post 15 via bolts or screws using mounting holes 19.

FIG. 5 describes yet another embodiment. Here, the acutely angled cut off stake 52 top bolts directly to the post 15 using mounting hole 33. The bottom bolt can be secured with the aid of a wedge-shaped spacer 32. The bottom mounting hole 35 in this case penetrates both the stake 52 and the spacer 32.

Futher modifications of the stake itself can facilitate direct-post attachment of the stake with no secondary attachment device. FIG. 7 displays the obtusely bent or retooled end of stake 56 forming a vertical head 34 for front post attachment.

OPERATION—FIGS. 1 & 9

The following describes the typical retrofit installation of this invention as illustrated in FIG. 1:

Dig a footing hole 36 adjacent to the existing foundation 38 of a weakened fence post 15. Size this hole 36 a width and depth normally meant to support a typical fence post. The usual hole orientation is off the fenceline. This hole location allows ease of installation. Here, digging room is provided without disassembling the fence.

Install a temporary post support structure to eliminate subsequent post movement. A long wooden stick shall suffice to brace the post top to a grounded wooden stake some distance off the fenceline. Place the invention within this new dug hole 36. Position the stake 12 at a substantial (1.5' to 2') depth. Do not allow it to touch the bottom or sides of the hole 36. This allows the concrete to encapsulate the below-ground metal. Accordingly, this discourages moisture entry and subsequent rust. The attachment plate 14 orients vertically—putting the stake orientation at a slant. The attachment plate 14 centers on the post 15—its lower edge about 3" above the ground 13. To attain this height, the adjacent lip 40 of the existing foundation 38 may need some removal. The angular orientation of the stake 12 minimizes this removal.

To mount this invention, drill post mounting holes (matching plate mounting holes 16 & 17) completely through the post 15. Install through bolts 100 (FIG. 8) in these mounting holes 16 & 17. Bolt orientation is with heads on the back side of the post 15 opposite the invention. Washers are recommended with the heads to ensure a snug fit. Washered nuts against the attachment plate 14 complete the post mounting of the invention.

Figure 8:
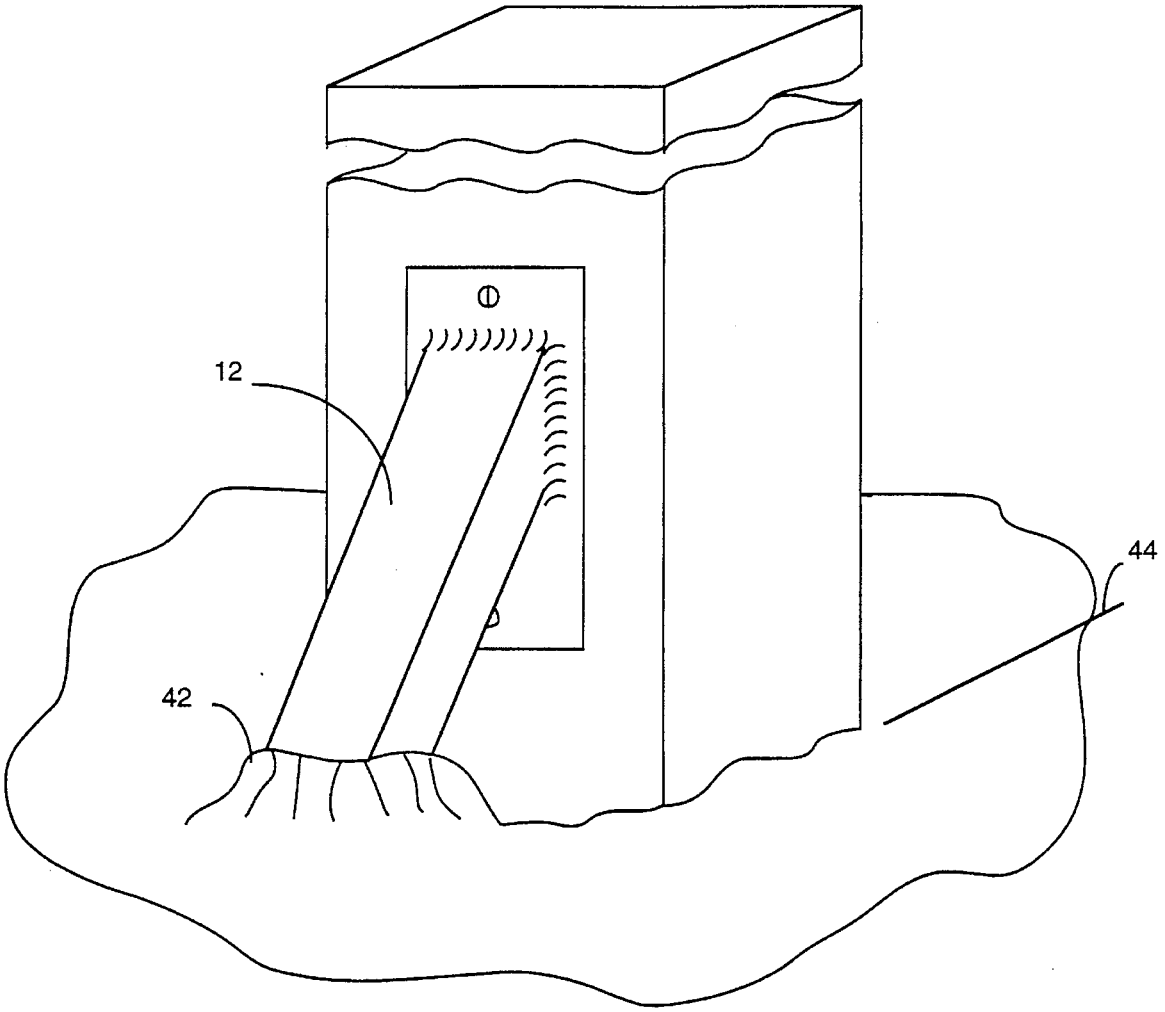
FIG. 8 is a perspective view of the anchoring device in position after the poured concrete has hardened.

Pour concrete to make the top level mound up to the stake sides. As depicted in FIG. 8, the level of new concrete 42 adjacent to the stake 12 must be slightly above the ground level 44 for drainage. This also discourages subsequent rust damage or concrete foundation damage.

Remove the temporary post support and backfill to suit after the concrete has substantially hardened.

Figure 9:
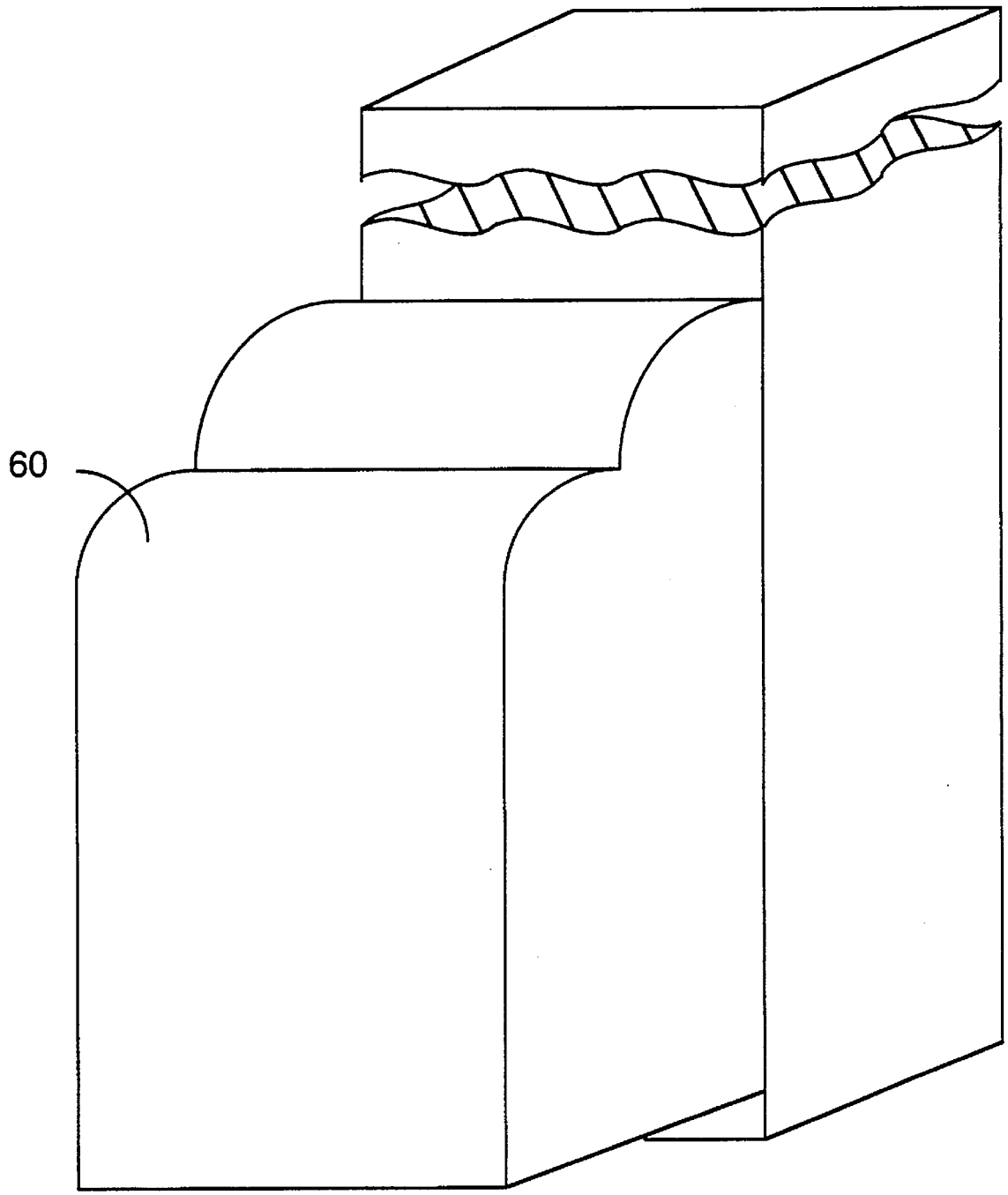
FIG. 9 is a perspective view of the anchoring device hidden by an optional decorative cover.

The installed product now has a slim profile. The invention is narrower than the post. And it minimally protrudes outward from the fenceline. As shown in FIG. 9, a decorative cover 60 can be easily placed over the invention if desired. Among reasons to do this would be to hide a mechanical appearance or to protect the invention.

SUMMARY, RAMIFICATIONS, AND SCOPE

In summary, I show several aforementioned objects and advantages attained. The strength gained is through the use of welded square tubed steel. This is further solidified by a deep set concrete pour and post through bolts. Careful excavation, welldrained poured concrete, and rustproof paint provide longevity. Standard steel sizes and a 2-piece design make manufacturing easy. The offset footing hole offers a quick and painless installation. And the finished product can look very attractive with the right cover.

While the preceeding patent application allows anyone skilled in the art to reproduce this invention, it shall not be construed to be an absolute representation of the product. Many further ramifications are still possible. Among these are different sizes, shapes and materials of the stake and attachment devices shown in the listed embodiments. Other embodiments of the slanted stake as well are possible. Even the application can vary from fencing such as signposts, lampposts, mailbox posts or others.

Hence, the following claims and their legal equivalents shall define the true scope of this invention.

What is claimed is:

1. A method of repairing an axially extending fence post using a low profile self-supporting anchoring device having an axially extending post attachment member for attaching said anchor device to said fence post and a stake having a first free end and a second end joined to said attachment member such that said stake extends from said attachment member at a fixed acute angle, the method comprising the steps of:

a) forming a hole adjacent to said fence post;

b) inserting said first free end of said stake within said hole, said second end being oriented such that said attachment member is adjacent to said fence post;

c) orienting said attachment member relative to said fence post such that the axis of said attachment member is generally parallel to the axis of said fence post;

d) attaching said attachment member to said fence post; and e) securing said first free end of said stake within said hole.

2. A method as described in claim 1 wherein said step e) comprises the step of pouring concrete into said hole to secure said first free end of said stake.

3. A method as described in claim 1 further comprising the step of protecting said anchor device by covering said anchor device with a cover.

4. A method as described in claim 1 wherein said stake is a metal rod.

5. A method as described in claim 1 wherein said stake is a metal tube.

6. A method as described in claim 1 wherein said attachment member is joined to said stake using a weld.

7. A method as described in claim 1 wherein said step d) comprises the steps of:

inserting bolts through holes located within said attachment member and placing said bolts into drilled holes of said fence post.

8. A method as described in claim 1 wherein said attachment member is a flat plate having at least one screw hole.

9. A method as described in claim 1 wherein said attachment member is a metal channel stock having at least one screw hole.

10. A method as described in claim 1 wherein said attachment member is a right angle stock having at least one screw hole.

11. A method as described in claim 1 wherein said attachment member is a polygon shaped gusset.

12. A method as described in claim 1 wherein said attachment member includes a wedge shaped spacer for mounting flush with said long axis of said fence post and flush with one surface of said stake.

13. A method as described in claim 1 wherein step b) comprises the step of inserting said free end of said stake into said hole to a depth of approximately 1.5 to 2.0 feet beneath ground level.

14. A method as described in claim 1 wherein said step c) comprises the step of positioning said attachment member such that a lower edge of said attachment member is approximately 3 inches above ground level.

15. A method of repairing an axially extending fence post by using a low profile self-supporting anchor device, said anchor device including an axially extending attachment member and a stake, said method comprising the steps of:

a) forming a hole adjacent to said fence post;

b) inserting a first free end of said stake within said hole, said stake having a second end coupled to said axially extending attachment member for attaching said stake to said fence post, said second end being oriented such that said attachment member is adjacent to said fence post and wherein said stake extends from said attachment member at a fixed acute angle;

c) orienting said attachment member relative to said fence post such that the axis of said attachment member is generally parallel to the axis of said fence post;

d) attaching said attachment member to said fence post; and e) securing said first free end within said hole.

16. A method as described in claim 15 wherein said step e) comprises the step of pouring concrete into said hole to secure said first free end of said stake.

17. A method as described in claim 15 wherein said attachment member is a metal channel stock having a screw hole and wherein said stake is a metal rod.

18. A method as described in claim 15 wherein said attachment member is a right angle stock having a screw hole and wherein said stake is a metal rod.

19. A method as described in claim 15 wherein step b) comprises the step of inserting said free end of said stake into said hole to a depth of approximately 1.5 to 2.0 feet beneath ground level.

20. A method as described in claim 15 wherein said step c) comprises the step of positioning said attachment member such that a lower edge of said attachment member is approximately 3 inches above ground level.

* * * * *